United States Patent [19]

Spiekermann, III et al.

[11] 4,010,703

[45] Mar. 8, 1977

[54] END LINING WITH HOT MELT

[75] Inventors: John Clements Spiekermann, III, Justice; David J. Rosbe, Hickory Hills; Edmund M. Kulesa, South Holland; James Kulik, Chicago; David F. Brasel, Worth, all of Ill.

[73] Assignee: The Continental Group, Inc., New York, N.Y.

[22] Filed: Dec. 17, 1975

[21] Appl. No.: 641,417

[52] U.S. Cl. ..... 113/120 Y; 113/120 C; 220/67; 220/77; 220/81 R

[51] Int. Cl.[2] ..... B21D 51/30

[58] Field of Search ..... 113/1 E, 1 F, 120 A, 113/120 K, 120 V, 120 XY, 120 Y, 120 R, 121 R, 121 A, 121 C, 121 AB; 156/69; 220/67, 77, 79, 80, 81 R

[56] References Cited

UNITED STATES PATENTS

| | | | |
|---|---|---|---|
| 2,313,750 | 3/1943 | Hothersall | 113/121 R |
| 2,643,627 | 6/1953 | Wobbe | 113/120 Y |
| 3,263,636 | 8/1966 | Smith | 113/121 C X |
| 3,437,063 | 4/1969 | Battersby | 113/121 R |
| 3,774,560 | 11/1973 | Hartz | 113/120 Y |

*Primary Examiner*—Leon Gilden

*Attorney, Agent, or Firm*—Paul J. Lerner; Joseph E. Kerwin; John J. Kowalik

[57] ABSTRACT

An improved method of providing a sealant layer in the double seam joining a can end panel and body. A dual band of molten resinous thermoplastic hot melt material is applied to the end unit and reflowed to obtain preferred placement. After double seaming, the material may be reflowed again to improve sealant continuity and to provide an improved sealing fillet between the end panel and body.

11 Claims, 4 Drawing Figures

END LINING WITH HOT MELT

SUMMARY OF THE INVENTION

This application relates to cans and, more particularly, to cans having an end panel joined to a body by a double folded seam.

Metal can ends for double-seaming onto flanged can bodies are customarily provided with a channel formation which receives the body flange when the end is dropped onto the body in readiness for seaming. Each channel formation comprises a seaming panel, a curl integral with the outer edge of said seaming panel, a chuck wall at the inner edge of said seaming panel, and a seaming panel radius integrally connecting said chuck wall and said seaming panel.

Prior to positioning the can ends onto the can bodies in readiness for seaming, it is customary to run said ends through a coating machine which coats the channel formation of each end with a plastic sealing compound to not only prevent leakage in the completed seam but to cushion the seaming operation and avoid breaking of any enamel or lacquer coatings which may be employed. In the application of such cushion seals to the can ends, it is customary to coat the entire width of the seaming panel, the curl, the seaming panel radius and about half of the height of the chuck wall.

Extensive experimentation has shown that such conventional coating makes it difficult to form a perfect double seam because of the existing excess of sealing compound. Moreover, in the completed seam, the excess compound tends to cause a void within the body hook radius and it also tends to cause shortened hooks in the seam. Then, too, it frequently produces cans of abnormal height which sometimes bind in runways and conveyors. Finally, use of conventional sealants requires expensive processing to control solvent emissions during manufacture to prevent air pollution.

The present invention is aimed to overcome these difficulties and at the same time to reduce the consumption of sealing compound by providing a novel method of applying a hot melt material and reflowing the same to achieve proper placement thereof.

With the above and other objects in view that will hereinafter appear, the nature of the invention will be more clearly understood by reference to the following detailed description, the appended claims and the several views illustrated in the accompanying drawing.

DESCRIPTION OF THE PREFERRED EMBODIMENT

In keeping with the present invention, there is provided an end panel E having a conventional channel portion. This channel portion comprises a seaming panel P, a curl C integral with the outer edge of said seaming panel P, a chuck wall W at the inner edge of said seaming panel P, a seaming panel radius R integrally connecting the lower end of said chuck wall W with said seaming panel P, and a chuck wall radius R integrally joining the upper end of said chuck wall W with the disk portion of the end E.

Figure 1:
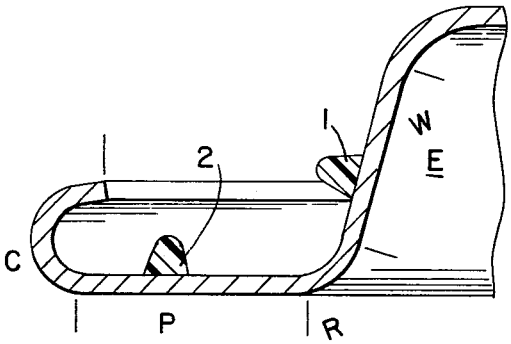
FIG. 1 is a fragmentary side plan view of an end panel illustrating the initial placement of the hot melt material.

As best shown in FIG. 1, two annular bands 1 and 2 of hot melt material are applied to the inner surface of the channel portion, the first band 1, comprising approximately 60% of the material deposited, being located near the midpoint of the chuck wall W and the second band 2, comprising approximately 40% of the material, being located near the midpoint of the seaming panel P. The material, which is preferably a resinous polyamide such as No. 824 Flange Cement produced by the Terrell Corporation of Wilmington, Massachusetts, is deposited, while in a molten state, by a conventional single station end lining machine. As applied to a 2-11/16 inch diameter can, the first band 1 is approximately 0.007 inches inches thick and covers about 10% of the area of the chuck wall W, while the second band 2 is approximately .012 inches thick and covers about 10% of the seaming panel P.

Figure 2:
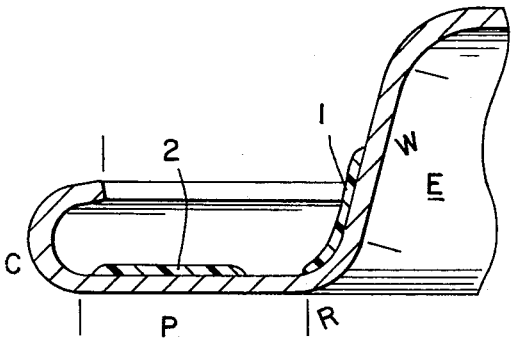
FIG. 2 is a view similar to FIG. 1, illustrating the position of the hot melt after reflowing.
Figure 4:
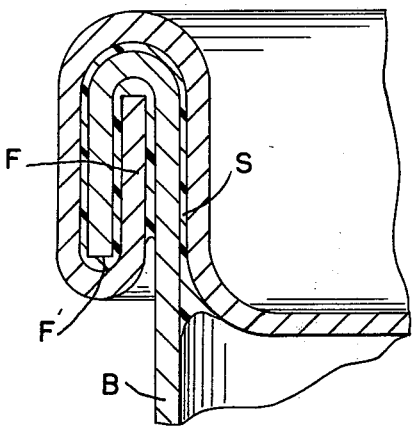
FIG. 4 is a view similar to FIG. 3, illustrating the results of a second reflowing of the hot melt material.

After the hot melt material has been applied, the end panel E is heated causing the material to melt and reflow to the desired placement positions as shown in FIG. 2. Experience has indicated that, in the case of the previously mentioned Flange Cement, heating at a temperature of 300° F. for a period of 15 minutes is optimum. It has also been noted that reflowing the material along the end panel surface causes improved adhesion thereto. After this reflowing, the first band is approximately 0.003 inches thick and covers about 25% of the area of the chuck wall W, while the second band 2 is approximately 0.004 inches thick and covers about 30% of the seaming panel P.

Figure 3:
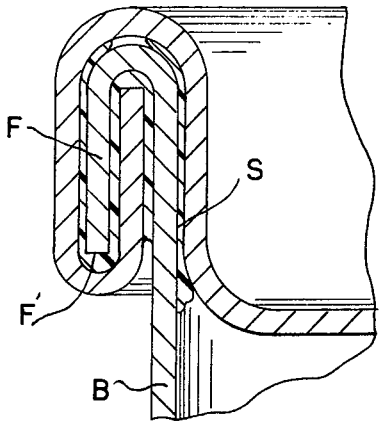
FIG. 3 is a fragmentary side plan view of the end panel of FIG. 2 double seamed to a body.

Once the material is in the desired position, the end panel E is joined to the body B by a double-lapped seam in the conventional manner. As shown in FIG. 3, the hot melt material of the second band 2 encapsulates the cutedge F′ of the body flange F thereby providing sealing conformance, while the material of the first band 1 provides a fillet S for coverage of the channel portion of the end panel E and the body flange F, preventing product exposure to the metal substrate in cases where the double seaming operation has caused fracture of the enamels or lacquers applied to these surfaces. This fillet S may be reflowed after the double seaming operation to provide improved continuity and improved adhesion to the body B, thereby further increasing protection from metal exposure, and also to smooth the end configuration at the juncture of the end panel E and the body B.

Experience indicates that use of this method reduces sealant consumption by approximately ⅔, with the 2-11/16 inch diameter can, for example, now requiring about 76 cu. m.m. of sealant.

We claim:

1. In a container having an end panel joined to a body by a double lapped seam, an improved method of providing a sealant in said seam comprising the steps of:
   - providing an end panel having a peripheral channel portion,
   - depositing a quantity of hot melt material in said channel portion in a first position,
   - heating said deposited material causing the same to reflow, to a second preferred position, and
   - double seaming said end panel with the reflowed material to said body.

2. The method of claim 1, wherein said material is initially deposited in said channel portion to form two separate annular bands.

3. In a container having an end panel joined to a body by a double lapped seam, an improved method of providing a sealant in said seam comprising the steps of:

providing an end panel having a peripheral channel portion, said channel portion comprising a seaming panel, a curl integral with the outer edge of said seaming panel, a chuck wall at the inner edge of said seaming panel, and a seaming panel radius integrally connecting said chuck wall and said seaming panel, depositing a quantity of hot melt material in said channel portion to form two initially separate annular bands, one of said bands of material being deposited on said chuck wall and the other band being deposited on said seaming panel, heating said deposited material causing same to reflow, thereby achieving a preferred placement thereof, and double seaming said end panel with said reflowed material to said body.

4. The method of claim 3, wherein said band on said seaming panel comprises approximately 60% of the material deposited and said band on said chuck wall comprises approximately 40%.

5. The method of claim 3 and reheating said deposited reflowed material causing the same to reflow subsequent to said double seaming.

6. The method of claim 3, wherein said band as deposited on said chuck wall is substantially twice as thick as said band as deposited on said seaming panel.

7. The method of claim 6, wherein said band as deposited on said chuck wall is approximately 0.007 inches thick and said band as deposited on said seaming panel is approximately 0.012 inches thick.

8. The method of claim 3, wherein said band as deposited on said chuck wall covers approximately 10% of the area thereof and said band as deposited on said seaming panel covers approximately 10% of the area thereof.

9. The method of claim 3, wherein, after said reflowing, said band on chuck wall is approximately 0.003 inches thick and said band on said seaming panel is approximately 0.004 inches thick.

10. The method of claim 3, wherein, after said reflowing, said band on said chuck wall covers approximately 25% of the area thereof and said band on said seaming panel covers approximately 30% of the area thereof.

11. In a container having an end panel joined to a body by a double lapped seam, an improved method of providing a sealant in said seam comprising the steps of:

providing an end panel having a peripheral channel portion comprising a curl, a substantially radially extending portion, and a substantially axially extending portion, depositing a quantity of hot melt material in said channel portion to form two initially separate annular bands, one of said bands being applied on said radially extending portion and the other band being deposited on said axially extending portion, heating said deposited material causing the same to reflow, thereby achieving a preferred placement thereof, and double seaming said end panel with said reflowed material to said body.

* * * * *